United States Patent [19]

Humphrey et al.

[11] 4,088,466

[45] May 9, 1978

[54] MULTI-POSITION AIR CONDITIONING UNIT

[75] Inventors: Joseph R. Humphrey, Avon Lake; Mickey F. Hickey, Grafton Township, Lorain County; Ronald J. Nemeth, Elyria, all of Ohio

[73] Assignee: Westinghouse Electric Corp., Pittsburgh, Pa.

[21] Appl. No.: 728,485

[22] Filed: Sep. 30, 1976

[51] Int. Cl.[2] ..... F25D 21/14; F25B 27/00

[52] U.S. Cl. ..... 62/286; 62/326

[58] Field of Search ..... 62/285, 326, 286; 165/48, 137

[56] References Cited

U.S. PATENT DOCUMENTS

| | | | |
|---|---|---|---|
| 2,690,654 | 10/1954 | Graham | 62/326 |
| 3,000,193 | 9/1961 | Crider | 62/285 |
| 3,089,315 | 5/1963 | Brandt | 62/326 |
| 3,097,507 | 7/1963 | Makuh | 62/285 |
| 3,299,660 | 1/1967 | Sullivan | 62/285 |
| 3,583,175 | 6/1971 | Eubank | 62/326 |
| 3,596,475 | 8/1971 | Berger | 62/286 |
| 3,678,993 | 7/1972 | Pierce | 62/326 |
| 3,712,078 | 1/1973 | Maynard et al. | 62/326 |

*Primary Examiner*—Lloyd L. King
*Attorney, Agent, or Firm*—E. C. Arenz

[57] ABSTRACT

The air conditioning unit has a refrigerant evaporator diagonally disposed within the air conditioning cabinet and includes a condensate drain trough at the opposite edges of the evaporator adjacent the front and rear wall of the cabinet, a drain pan assembly extending along the rear wall of the cabinet, and a detachable drip tray which is located in one position on the upstream face side of the evaporator when the cabinet is in a vertical disposition and is located on the upstream face of the evaporator in another position to feed condensate to the other drain trough when the cabinet is in one of its horizontal dispositions, the relationship between the two drain troughs, drain pan and drip tray accommodating the installation of the cabinet in a vertical disposition, and alternatively in a horizontal disposition with either the front or the rear face of the cabinet on top. The multiple dispositions of the cabinet available with the invention permit the air conditioning unit to be installed in locations facilitating access to the interior of the cabinet from the front face side of the cabinet.

3 Claims, 7 Drawing Figures

MULTI-POSITION AIR CONDITIONING UNIT

BACKGROUND OF THE INVENTION

1. Field of the Invention

The invention relates to air conditioner cabinets with refrigerant evaporators therein and of structural arrangements thereof accommodating multiple dispositions of the cabinets.

2. Description of Prior Art

The type of air conditioner unit which will be used as an example for purposes of describing the invention basically includes a cabinet, a refrigerant evaporator coil therein, a fan or blower unit for creating a draft of air through the cabinet, electrical components and controls and in some cases supplemental electric heat elements. Each of the spaces occupied by these elements noted may require access thereto and accordingly access panels are typically provided to form one face of the cabinet.

Depending upon the particular building construction in which the air conditioning unit is to be installed, it is desirable that a given unit be adaptable to either an up-flow application, in which the air passes upwardly through the unit which is in a vertical disposition, or in a horizontal application in which the unit is disposed horizontally and the air passes horizontally through the unit. In the horizontal application the unit may be installed in an attic, for example, in which access to the interior is preferably had by removing panels from the top face of the unit; or in the horizontal application the unit may be attached to the ceiling so that it is preferable that the access panels be on the bottom of the unit. One problem which arises with units of this type which can be installed in various different dispositions is that the moisture which condenses upon the cold evaporator coil must be handled and collected and passed to a drain.

This problem has of course been recognized in the air conditioning field and air conditioning units adapted for different dispositions have been disclosed and are in commercial use.

For example, both U.S. Pat. Nos. 3,596,475 and 3,299,660 teach air conditioning units in which the units may be installed in either a vertical disposition or in a horizontal disposition. However, in the case of the horizontal disposition, the units may be installed in only one orientation; that is, they may not be installed in an upside down position.

U.S. Pat. No. 3,089,315 discloses an air conditioning unit which may only be installed in a vertical disposition, but it may be turned upside down in the vertical disposition by removing the evaporator coil and reinstalling it in a different orientation.

U.S. Pat. No. 3,678,993 teaches an air conditioning unit which has a plurality of interchangeable side, top and bottom panels which may be shifted to permit air flow in any of various directions without repositioning of the heat exchange coil.

With respect to the teachings of these patents and any other prior art of which we are aware, our arrangement possesses the distinct advantage of being applicable in a horizontal position with either the front or the rear face up to permit access to the unit from the desired direction, without requiring any panel interchange, and also does not require removal of the evaporator coil from the unit for reorientation.

SUMMARY OF THE INVENTION

In accordance with the invention, the air conditioning unit is adaptable for installation in a vertical disposition and a horizontal disposition and includes a cabinet which has front and rear faces and has blower means for creating air flow through the cabinet in one direction, with the cabinet being adapted to receive air therein through a front face inlet and alternatively an end inlet, the cabinet front face including access panel means separable from the cabinet, a fin and tube evaporator coil angularly disposed in the cabinet with its upstream face presented to both the front face inlet and the end inlet areas, a first condensate drain trough at the end of the coil adjacent the front wall and having a drain aperture therein in the portion of the trough facing the end inlet area, a second drain trough and a drain pan assembly including a trough portion encompassing that end of the coil adjacent the rear wall and a pan portion extending along the rear wall over an area upon which condensate would drop from said coil when the cabinet is disposed horizontally with the rear wall in the bottom, the drain trough having a drain aperture in both the portion of the trough facing the end inlet area and the portion facing the front inlet area and a detachable drip tray having one position on the upstream face side of the coil for feeding condensate to the second drain trough when the cabinet is in a vertical disposition and having an alternative position on the upstream face side of the coil to feed condensate to the first drain trough when the cabinet is in a horizontal disposition with the rear face of the cabinet on top.

DRAWING DESCRIPTION

DESCRIPTION OF THE PREFERRED EMBODIMENT

Figure 1:
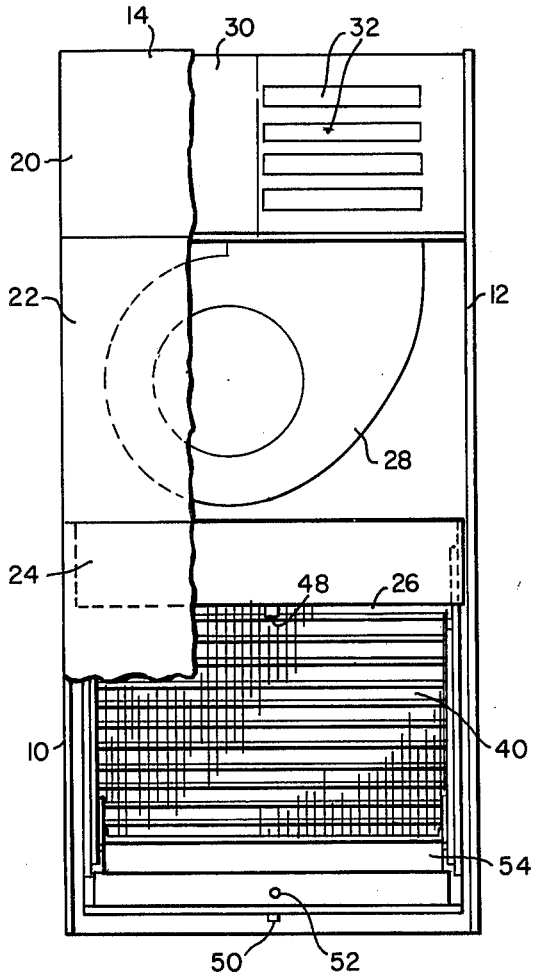
FIG. 1 is a front face view of an air conditioning unit according to the invention in a vertical disposition and with parts of the front access panels broken away.

Referring to the drawing, the particular air conditioning unit illustrated is typically characterized as the indoor section of a split system heat pump which includes supplemental electric resistance heat.

The cabinet includes left side wall 10, right side wall 12, a top wall 14 with a flanged discharge air outlet 16 (FIG. 2), rear wall 18 and, forming the front face of the unit in FIG. 1, a series of three access panels which are separable from the cabinet. These access panels include the top electrical compartment panel 20, the middle blower and motor panel 22, and the bottom coil panel 24. Correspondingly, the unit is divided interiorly to include a refrigerant evaporator coil 26 in the lower section, a blower 28 in the center section, and an electrical component space in the top section 30 which also includes provision for supplemental electric heating resistors 32 therein.

An air filter frame assembly (not shown) ordinarily is shipped with the unit and is installed either on the open bottom end 34 of the unit as viewed in its vertical disposition, or in place of the bottom coil access panel 24 if the air inlet is to be through the front face of the unit. The up-flow arrow 36 shown in FIG. 2 indicates the inlet of the air to the unit for an up-flow application in its vertical position, and the arrow 38 indicates the direction of return air flow into the unit in the front when the filter frame assembly is installed in place of the front access panel 24.

The evaporator coil 26 is of the fin and tube type in which the closely spaced fins lie in planes parallel to the side walls of the cabinet, and is angularly disposed in the cabinet with its upstream face 40 presented to both the front face inlet when the access panel 24 is omitted and to the end inlet 34.

Figure 3:
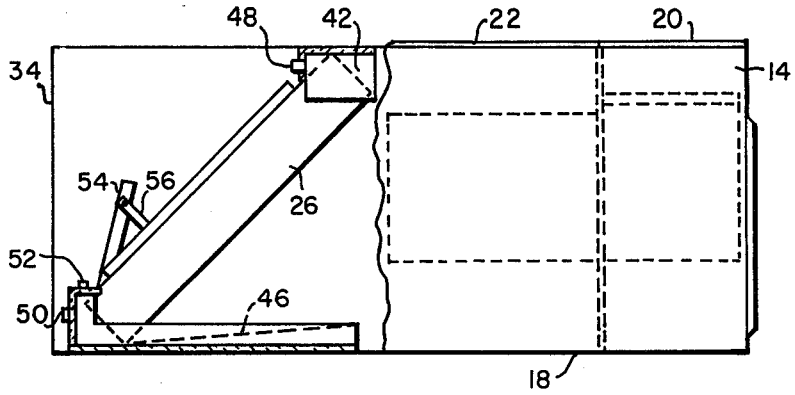
FIG. 3 is a right side view of the unit of FIG. 1 disposed in a horizontal position with the access panels on the top of the unit.

Both of the opposite end edges of the coil are provided with condensate drain troughs encompassing these ends, the first drain trough 42 being provided on that end of the coil adjacent the front wall, and the second drain trough 44 encompassing that end of the coil adjacent the rear wall 18. The second drain trough 44 comprises a part of a drain trough and drain pan assembly which also includes a pan portion 46 which extends along the rear wall and is generally coextensive in area with the sideways projected area of the downstream face of the coil 26. As shown, the drain pan 46 is inclined slightly so that when the air conditioning unit is installed in a horizontal application as is shown in FIG. 3, condensate dropping from the downstream face of the coil onto the drain pan 46 will flow by gravity into the second drain trough part 44 of the drain trough and drain pan assembly.

The first condensate drain trough 42 is provided with a drain outlet fitting 48 in its portion facing the end inlet area, and the second drain trough 44 is provided with two drain outlet fittings, one 50 being in its portion facing the end inlet area, and the other 52 being in its portion facing the front inlet area. All of the drain fittings are in the portions of the condensate trough which are at the lowest level of the trough depending upon the disposition of the air conditioning unit. When the unit is in the vertical position of FIGS. 1 and 2 for an up-flow application, the fitting 52 is capped.

Figure 4:
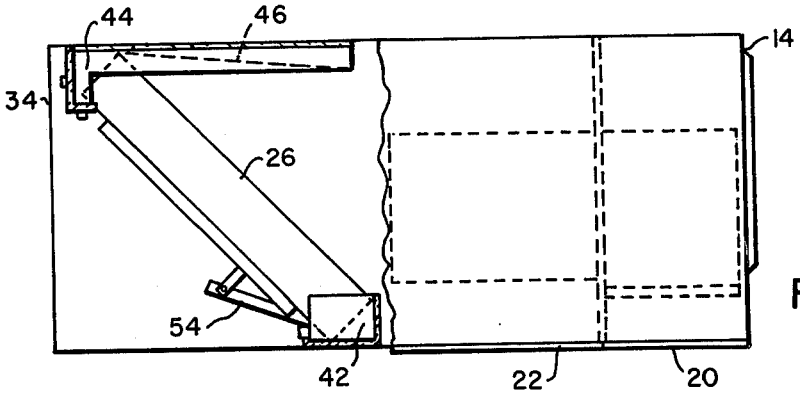
FIG. 4 is a left side view of the unit of FIG. 1 with the unit in a horizontal position and the access panels on the bottom face of the unit.

The air conditioning unit of the invention also includes a detachable drip tray 54 which has a length sufficient to encompass the width of the coil, and has a bottom edge (as viewed in FIGS. 1 and 2) including a flange or lip (not shown) which overlies an edge of the second drain trough 44. The tray is inclined at an angle different from that of the coil 26 by a support arm 56 at each end of the tray. One end of each arm is fastened to the side plates of the coil and the other end of each arm is fastened to the drip tray. The unit as shipped has the detachable drip tray 54 secured in the position shown in FIGS. 1–3. If the unit is to be installed in a horizontal position with the front face access panels on the bottom as shown in FIG. 4, the drip tray 54 is detached from its shipped position and is reinstalled in the position shown in FIG. 4. It is generally desirable to leave the tray in its shipped position for operation of the unit in a vertical position, regardless of whether the return air enters from the front, or from the bottom, but when the unit is to be operated in a horizontal application as shown in FIG. 3 the drip tray may be removed if desired. If it is left in its shipped position for a FIG. 3 application, the obstruction to air flow afforded by the drip tray does not significantly affect the operation of the unit.

When the unit is installed in a vertical disposition, and regardless of whether the return air enters from the front or the bottom, the condensate which forms on the coil surfaces flows along the fins down into the second drain trough 44. The detachable drip tray is provided to catch condensate which may have a greater tendency to drop off the lower portion of the coil than the upper portion of the coil for reasons which will be explained hereinafter. The condensate flow along the coil is basically the same as explained in connection with FIG. 2 when the unit is installed horizontally and in the front access panel down position as shown in FIG. 4.

In the FIG. 3 position, the condensate forming on the coil will flow in part down along the fins of the coil and in part will drop off the trailing edges of the fins onto the drip pan 46 from which it will flow to the second drain trough 44 for disposal out of the drain fitting 50.

Figure 5:
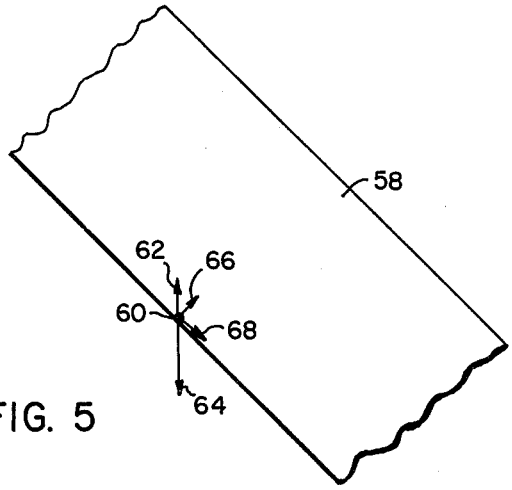
FIGS. 5–7 are fragmentary side views of a single fin of the evaporator coil with vectorial representations illustrating our understanding of the forces upon a condensate drop.
Figure 6:
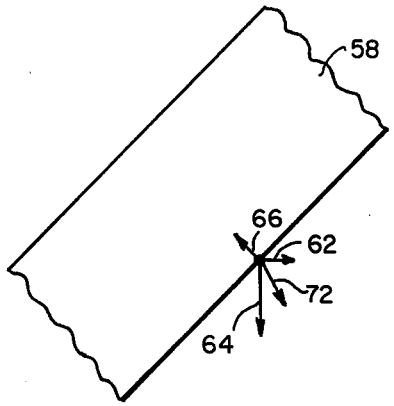
Figure 7:
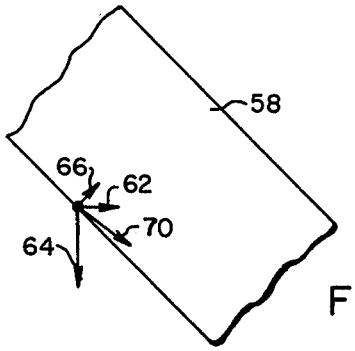

FIGS. 5, 6 and 7 are presented to illustrate vectorially our view on the general effect of the forces acting upon a condensate droplet. The vector arrows are intended mainly to represent the direction of the forces and are not intended to accurately portray the magnitude of the forces involved. In each of the Figures, a single fin is indicated by the numeral 58. The FIG. 5 view illustrates the forces upon a water droplet 60 in which the unit is in a vertical disposition with the return air entering the bottom end 34 of the unit. In this case the force applied to a water droplet by the air flow is indicated by the arrow 62, the force of gravity upon the droplet by the arrow 64 and the force of adhesion between a water droplet and the surface of the fin by the arrow 66. The resultant of these forces is indicated by the arrow 68 which, if it is assumed the length of the arrows correctly indicates the magnitude of the forces, shows that the water droplets will tend to move down along the fin without dropping off the fin.

Figure 2:
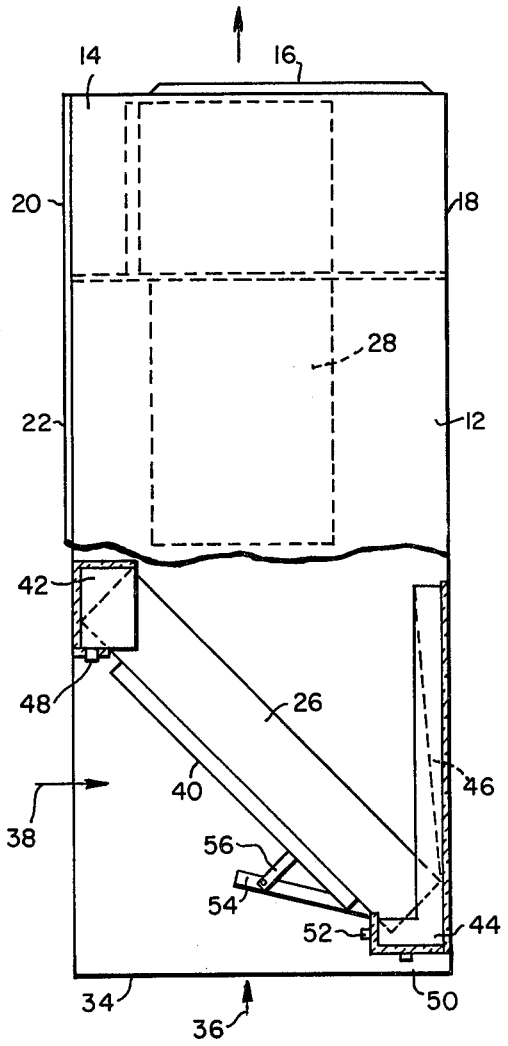
FIG. 2 is a partly broken right side view of the unit of FIG. 1.

The FIG. 7 representation corresponds to the disposition of the coil in a horizontal application as shown in FIG. 4, and also generally corresponds to the disposition of the coil for a vertical positioning of the unit as in FIG. 2 and when the return air inlet is at the front of the unit. In this case it will be seen that the resultant of the forces of the air flow 62, the force of gravity 64, and the force of adhesion 66 gives a resultant 70 which indicates the water droplet should tend to flow down the fin 58 and remain on the fin until it is received in the drain troughs.

Referring to FIG. 6, this corresponds to a horizontal application of the unit as in FIG. 3 and in which both the force of gravity and the force of the air flow tends to move water droplets off the trailing edges of the fins, the only counteracting force being that of the force of adhesion 66. As indicated, the resultant 72 will indicate that the water droplets will drop off the downstream face of the coil and be received by the drip pan 46.

While both FIGS. 5 and 7 would indicate that there is no necessity for the detachable drip tray 54, it has been found desirable because of the greater possibility that water will drop off the lower part of the coil than off of the upper part of the coil. One reason for this is that with the refrigerant entering the upper part of the coil and leaving the lower part of the coil, and at times having a degree of superheat in the lower part of the coil the warmer coil surface results in a decrease in the surface tension of the water. Also, residual coatings on the coil surface, such as oil from manufacturing, can also tend to decrease the forces of adhesion between the water and the coil.

With the arrangement according to the invention, the unit is shipped with the coil permanently fixed in one position, while accommodating the installation of the unit in either a vertical position, or a horizontal position with the front face either up or down, and avoids the problem of removal and reinstallation of the coil and associated parts in the field. While the detachable drip tray may require repositioning from one end of the coil to the other, this is a relatively simple mechanical operation and does not involve manipulation or disconnection of refrigerant lines to the coil which extend through the interior of the cabinet to and through the top end.

When the unit is installed in the vertical disposition in a closet, the front face access panels permit access to the interior of the unit. If the unit is installed in the horizontal disposition as in FIG. 3, access to the interior unit may be had from on top. When the unit is installed in the horizontal position as shown in FIG. 4, such as being suspended from a ceiling, access to the interior unit is had from the front face which is then on the bottom.

What we claim is:

1. An air conditioning unit adapted for installation in a vertical disposition and either of two horizontal dispositions comprising:

a cabinet including front and rear faces and containing blower means for creating air flow through said cabinet in one direction, said cabinet being adapted to receive air therein through a front face inlet and alternatively an end inlet, said cabinet front face having access panel means separable from said cabinet;

a fin and tube evaporator coil angularly disposed in said cabinet with its upstream face presented to both said front face inlet and said end inlet areas;

a first condensate drain trough encompassing that end of said coil adjacent the front wall;

a second condensate drain trough encompassing that end of said coil adjacent said rear wall;

a drain pan of relatively large area extending along the rear wall of said cabinet and facing the downstream face of said coil and inclined relative to the rear wall fo feed condensate into said second drain trough;

a detachable drip tray of relatively small area compared to said drain pan and facing the upstream face of said coil, and adapted to be positioned to feed condensate to said first drain trough in one horizontal position of said unit, and to feed condensate to said second drain trough in a vertical disposition of said unit.

2. An air conditioning unit according to claim 1 wherein:

said first condensate drain trough includes a drain aperture therein in the portion of said trough facing the end inlet area; and said second condensate drain trough includes one drain aperture in the portion of the trough facing the end inlet area, and another drain aperture in the portion of the trough facing said front inlet area.

3. An air conditioning unit adapted for installation in a vertical disposition and either of two horizontal dispositions comprising:

a cabinet including front and rear faces and containing blower means for creating air flow through said cabinet in one direction, said cabinet being adapted to receive air therein through a front face inlet and alternatively an end inlet, said cabinet front face having access panel means separable from said cabinet;

a fin and tube evaporator coil angularly disposed in said cabinet with its upstream face presented to both said front face inlet and said end inlet areas;

a first condensate drain trough encompassing that end of said coil adjacent the front wall and having a drain aperture therein in the portion of said trough facing said end inlet area;

a second condensate drain trough and drain pan assembly including a trough portion encompassing that end of said coil adjacent said rear wall and a pan portion extending along the rear wall over an area upon which condensate would drop from said coil when said cabinet is disposed horizontally with the rear wall on the bottom, said drain trough having a drain aperture in both the portion of said trough facing said end inlet area and the portion facing said front inlet area;

a detachable drip tray having one position on the upstream face side of said coil for feeding condensate to said second drain trough when said cabinet is in a vertical disposition, and having an alternative position on the upstream face side of said coil for feeding condensate to said first drain trough when said cabinet is in a horizontal disposition with said rear face on top;

the relationships between said coil drain troughs, drain pan and drip tray accommodating the installation of said cabinet in a vertical disposition, and in a horizontal disposition with either said front or rear face on top.

* * * * *